US006305282B1

(12) United States Patent
Dätwyler

(10) Patent No.: US 6,305,282 B1
(45) Date of Patent: Oct. 23, 2001

(54) DOCTOR BLADE FOR WIPING AWAY EXCESS PRINTING INK FROM THE SURFACE OF A PRINTING FORM

(75) Inventor: Max Dätwyler, Bleienbach (CH)

(73) Assignee: MDC Max Datwyler Bleienbach AG, Bleienbach (CH)

( * ) Notice: Subject to any disclaimer, the term of this patent is extended or adjusted under 35 U.S.C. 154(b) by 0 days.

(21) Appl. No.: 09/331,751

(22) PCT Filed: Oct. 21, 1998

(86) PCT No.: PCT/CH98/00447

§ 371 Date: Aug. 20, 1999

§ 102(e) Date: Aug. 20, 1999

(87) PCT Pub. No.: WO99/21716

PCT Pub. Date: May 6, 1999

(30) Foreign Application Priority Data

Oct. 24, 1997 (EP) ..... 97118522

(51) Int. Cl.[7] ..... B41F 9/00; B41F 9/10; B41F 31/00

(52) U.S. Cl. ..... 101/169; 101/154; 101/157; 101/350.6

(58) Field of Search ..... 101/154, 155, 101/157, 161, 167, 169, 350.6; 118/261, 413; 401/25; 427/356

(56) References Cited

U.S. PATENT DOCUMENTS

| | | | | |
|---|---|---|---|---|
| 2,313,830 | | 3/1943 | Lundbye . | |
| 2,359,770 | | 10/1944 | Lundbye . | |
| 4,162,652 | * | 7/1979 | Rebel et al. | 101/425 |
| 4,184,429 | | 1/1980 | Widmer . | |
| 4,651,672 | * | 3/1987 | Sommer | 118/126 |
| 5,143,745 | * | 9/1992 | Maganas et al. | 427/8 |
| 5,454,868 | * | 10/1995 | Mendez | 118/216 |
| 5,638,751 | | 6/1997 | Daetwyler . | |
| 5,681,387 | * | 10/1997 | Schmidt | 118/105 |
| 5,782,976 | * | 7/1998 | Marziale et al. | 118/118 |
| 5,824,154 | * | 10/1998 | Freti | 118/126 |
| 5,997,646 | * | 12/1999 | Madrzak et al. | 118/413 |

FOREIGN PATENT DOCUMENTS

| | | |
|---|---|---|
| 28 17 964 | 12/1979 | (DE) . |
| WO 86 07309 | 12/1986 | (WO) . |
| 9 300 810 | 12/1994 | (WO) . |

* cited by examiner

*Primary Examiner*—Kimberly L. Asher
(74) *Attorney, Agent, or Firm*—Alston & Bird LLP

(57) ABSTRACT

A doctor blade for wiping excess printing ink off the surface of a printing form (10) has a front section in the form of a leaf (3) which interacts with the surface of the printing form (10). In order to avoid wear or damage to the printing form surface as a result of the contact pressure exerted by the leaf (3) on the printing form surface, the leaf (3) is provided with a coating (5) over the entire doctor blade length. The coating (5) consists of lubricant or contains lubricant particles (8). As a result of the significant reduction in friction between the leaf (3) and the printing form surface, not only is the wear on the printing form surface reduced, but the wear on the doctor blade is also reduced, and its service life is extended.

11 Claims, 3 Drawing Sheets

B2
1
2
D1
D2
3
5
3B
4
B1
10
D

DOCTOR BLADE FOR WIPING AWAY EXCESS PRINTING INK FROM THE SURFACE OF A PRINTING FORM

BACKGROUND OF THE INVENTION

The invention relates to a doctor blade for wiping excess printing ink off the surface of a printing form.

A doctor blade of this type, which is used in the gravure printing process, for example, is disclosed by U.S. Pat. No. 4,184,429. The doctor blade comprises a rear doctor blade part, which is installed in a holder, and a front leaf, which rests on the surface of the printing form with a certain pressure. The leaf is significantly thinner than the rear part of the doctor blade (its thickness is approximately one half of the thickness of the rear part of the doctor blade). The advantage of this doctor blade is that when the front contact zone, which interacts with the surface of the printing form, wears, this contact zone remains as far as possible unchanged and unimpaired in terms of its size and geometry needed for the required print quality, until the entire width of the leaf has been used up or worn away. The constant geometric relationships in the area of contact, and hence also the constant doctor blade pressure, make manual readjustment of the contact pressure superfluous and permit constant print quality.

Even in the case of these doctor blades, however, there is the risk that the surface of the printing form, the uppermost chromium layer in the case of gravure printing forms, will be worn away or damaged by the doctor blade. In addition, the doctor blade is also subjected to wear. The tribology in relation to a steel doctor blade/chromium layer has always been a problem. In order to eliminate these disadvantages, DE-A-28 17 964 discloses a proposal to embed a lubricant in the doctor blade itself, this lubricant appearing in the contact zone and reducing the friction between the doctor blade and the printing form surface. This solution has the disadvantage that the properties of the doctor blade, for example its resilient behavior, are impaired by the embedded lubricant. In addition, this solution is difficult and expensive to produce.

In order to reduce the wear on the doctor blade, it is also known to coat the doctor blade with wear-resistant material in the region of the leaf. However, this solution increases the risk of wear or damage to the surface of the printing form.

The same problems also arise in the case of narrow doctor blades, which are formed from a thin metal plate which is firmly clamped between two supporting plates and has a constant thickness over the entire width of the doctor blade.

The present invention is based on the object of providing a doctor blade in which the wear on the surface of the printing form and the doctor blade wear are reduced considerably, without the properties of the doctor blade being impaired.

SUMMARY OF THE INVENTION

The above and other objects and advantages of the present invention are achieved by the provision of a doctor blade which comprises a front section which interacts with the surface of the printing form, and which has a predetermined length. A coating overlies at least one side of the front section of the blade along at least substantially the entire length thereof, with said coating comprising a lubricant or a, carrier material containing lubricant particles, and further comprising particles of a wear resistant material.

The doctor blade according to the invention has the advantage that the coating reducing the wear on the printing form surface is applied subsequently to the doctor blade, which is produced as hitherto, which is significantly simpler and more cost-effective in production terms than the solution already mentioned according to DE-A-28 17 964.

It is particularly advantageous to incorporate the lubricant particles in a layer in which the particles of a wear-resistant material, which reduce the wear on the doctor blade, are already present. A coating of this type results in a particularly effective reduction in the doctor blade wear and an increase in the surface life of the doctor blade, but nevertheless protects the printing form surface from wear.

Further preferred refinements of the doctor blade according to the invention form the subject matter of the dependent claims.

The invention will be explained in more detail with reference to the drawing, in which, in purely schematic form:

BREIF DESCRIPTION OF THE DRAWINGS

DETAILED DESCRIPTION OF THE PREFERRED EMBODIMENTS

Figure 1:
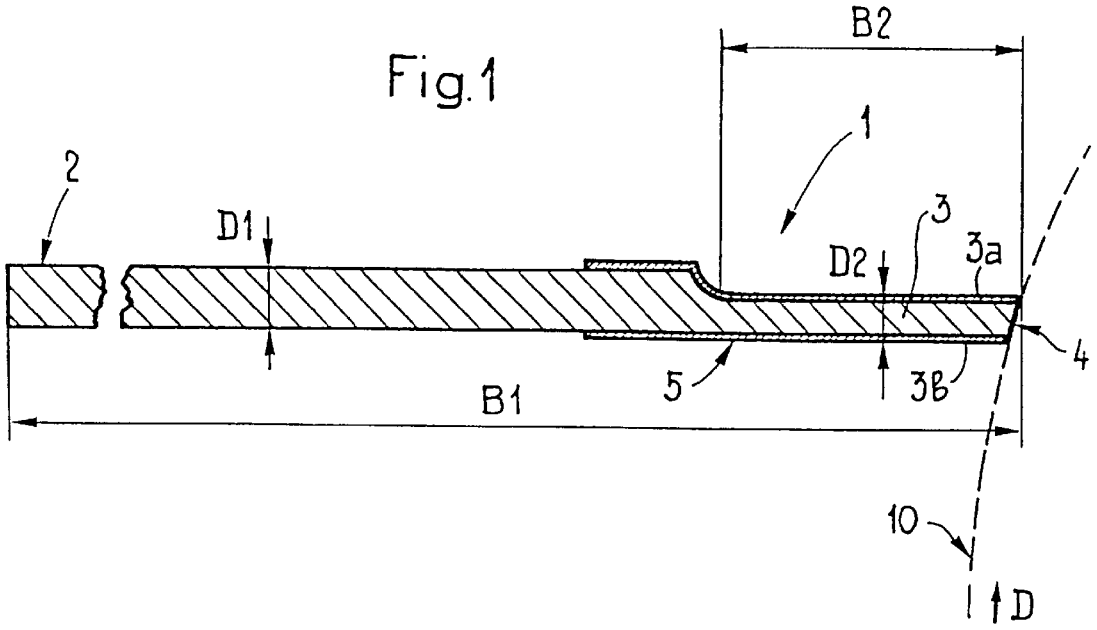
FIG. 1 shows an exemplary embodiment of a doctor blade in cross section and on an enlarged scale.

According to FIG. 1, a doctor blade 1 comprises a rear doctor blade part 2 and a front section in the form of a front leaf 3 which is in one piece with the latter and is thinner than the rear doctor blade part 2. For instance, the thickness Dl of the rear doctor blade part 2 is about 150 $\mu$, that of the leaf 3 (D2) about 50$\mu$. The upper side of the leaf 3 is designated by 3*a* in FIG. 1, the lower side is designated by 3*b*. The doctor blade width B1 may be 8–80 mm, for example, as required, the leaf width B2 being approximately 1 mm. Depending on the application, the doctor blade may have a different doctor blade length—measured in a plane at right angles to the plane of the drawing.

The doctor blade 1 is installed with its rear doctor blade part 2 in a holder (not illustrated in the drawing), if necessary together with a supporting doctor blade. The leaf 3 is pressed under a specific pressure onto the surface of a printing form 10, for example of a gravure printing cylinder, which is indicated schematically in the drawing with dashed lines, in order to wipe off the excess printing ink from the printing form. The direction of rotation of the printing form 10 is designated by an arrow D. The front contact zone of the leaf 3, which comes into contact with the printing form, is designated by 4 in FIG. 1. The exact geometry of the doctor blade, its positioning with respect to the printing form and its advantages are disclosed, for example, by U.S. Pat. No. 4,184,429 and will therefore not be described in detail here.

In order to reduce as far as possible the wear of that surface of the printing form 10 which is in contact with the doctor blade 1, for example the chromium layer of a gravure printing cylinder, the leaf 3 and also that region of the rear doctor blade part 2 which adjoins the leaf 3 are, according to the invention, provided over the entire doctor blade length with a coating 5 which consists of lubricant or at least has lubricant particles. As a result of the lubricant which is present in the contact area, the friction between the doctor blade 1 and the surface of the printing form 10 is reduced considerably, and the wear on the printing form surface is reduced.

Figure 2:
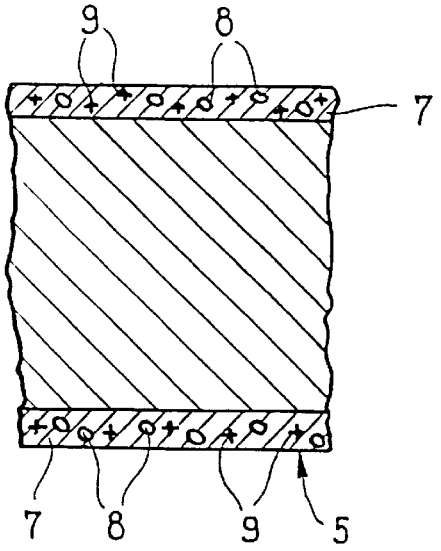
FIG. 2 shows a coated part of the doctor blade according to FIG. 1 in cross section and much enlarged.

As the example according to FIG. 2 shows, it is advantageous for the coating 5 to comprise a carrier material 7, in which both lubricant particles 8 and particles 9 of a wear-resistant material are embedded (the particles 8 and 9 are indicated purely schematically in FIG. 2). While the last-mentioned particles 9 reduce the wear on the doctor blade 1 and, respectively, on the leaf 3 and increase their service life, the lubricant particles 8 ensure that the wear on the printing form surface is reduced significantly—in spite of the presence of the particles 9 which, although they reduce the wear on the doctor blade, also rather tend to increase the risk of damage to the printing form surface.

The coating 5 has a thickness of a few microns, the lubricant particles 8 and the particles 9 of a wear-resistant material are smaller than $1\mu$. The coating 5 can be applied in various ways to the ready-produced doctor blade, for example chemically, by electroplating, by being sprayed on, by being adhesively bonded on and so on.

In the exemplary embodiment illustrated, both sides 3*a,* 3*b* of the front section or of the leaf 3 are coated. However, it would also be possible for only one of these sides 3*a,* 3*b* to be coated according to the invention, preferably the side 3*b* facing the direction of rotation D of the printing form 10.

However, it would also be possible to provide one of the sides 3*a,* 3*b* with the coating consisting of lubricant or containing lubricant particles, and to provide the other side with a coating having the particles of a wear-resistant material.

Figure 3:
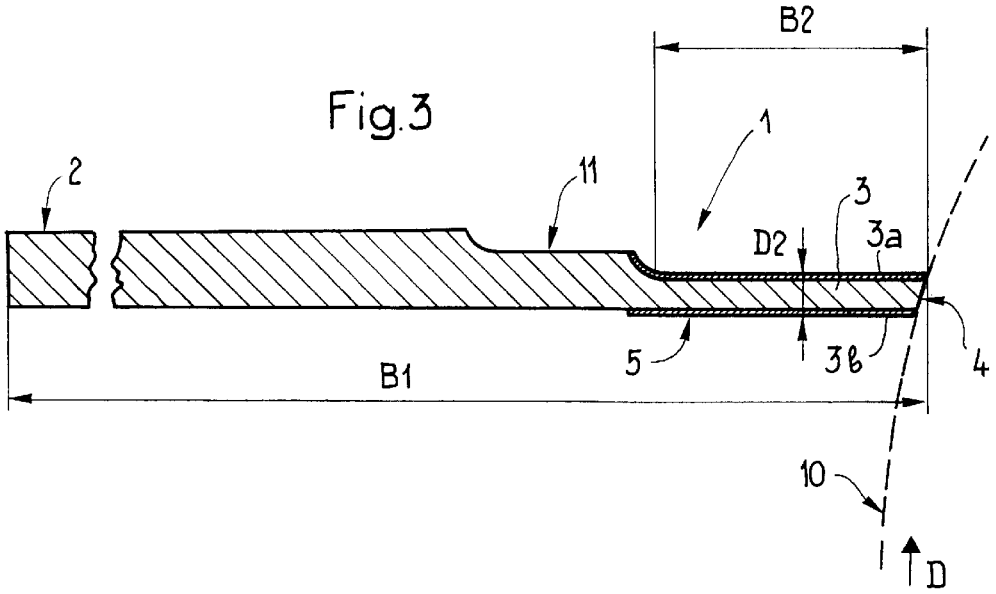
FIGS. 3–5 are each similar to FIG. 1 and illustrate further embodiments of the doctor blade.

The coating according to the invention could also be used in doctor blades as illustrated in FIG. 3 and which include an intermediate part 11 arranged between the front section or leaf 3 which interacts with the surface of the printing form, and the rear part 2. The intermediate part 11 is thicker than the front section or leaf 3, and thinner than the rear doctor blade part. Also the front section is coated in the manner described above.

Figure 4:
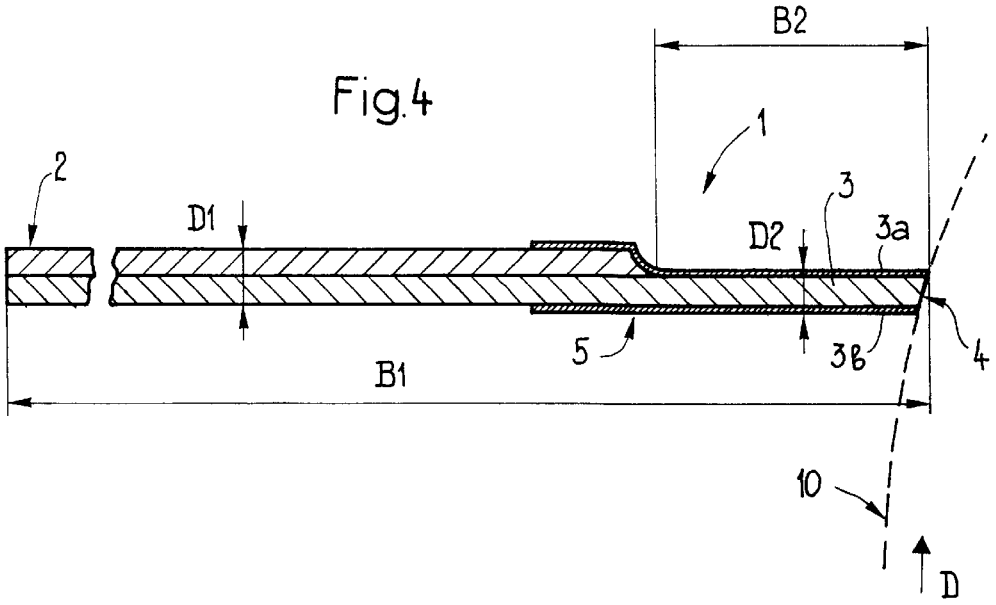

In the embodiments described above, the front section and the rear part, (and the intermediate part 11 in the embodiment of FIG. 3), are made in one piece. However, in the embodiment of FIG. 4, the rear part 2 comprises two or more parts or layers lying on top of one another and connected to one another.

Figure 5:
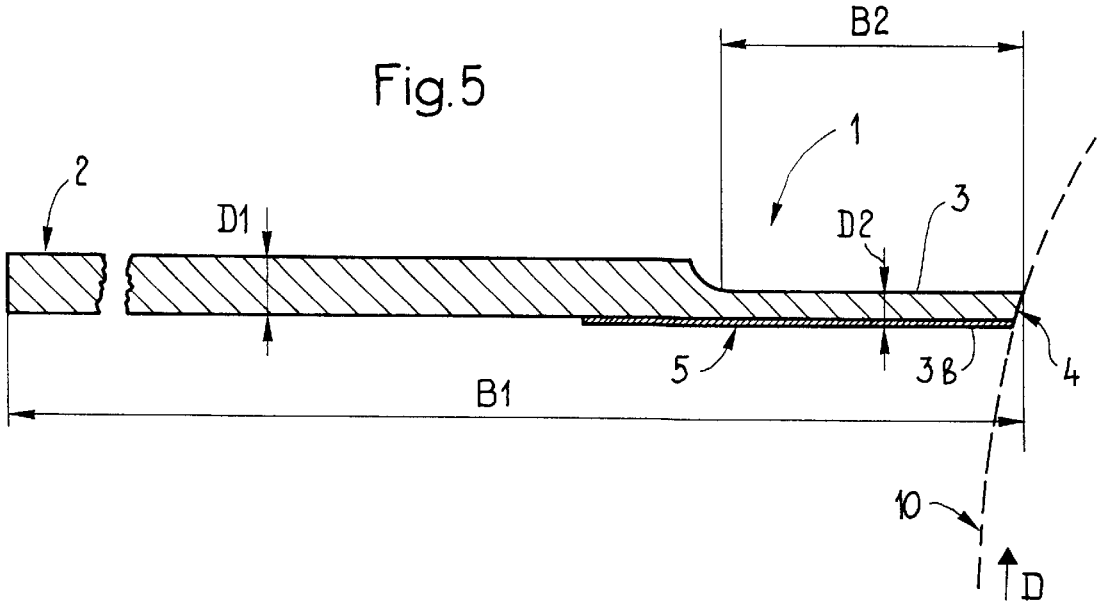

In the embodiment of FIG. 5, the coating 3*b* is applied to overlie only that side of the front section of the doctor blade which faces the direction of rotation of the printing form or cylinder 10.

What is claimed is:

1. A doctor blade for wiping excess ink off the surface of a printing form, comprising a front section which interacts with the surface of the printing form, and which has a predetermined length, and a coating overlying at least one side of the front section of the blade, along at least substantially the entire length thereof, with said coating comprising a lubricant or a carrier material containing lubricant particles, and further comprising particles of a wear resistant material.

2. The doctor blade as claimed in claim 1 wherein the coating comprises a carrier material in which lubricant particles and particles of a wear resistant material are embedded.

3. The doctor blade as claimed in claim 1 wherein the doctor blade further comprises a rear part which is adapted for installation in a holder and which is joined to the front section, and wherein the front section is thinner than the rear part.

4. The doctor blade as claimed in claim 3 wherein the rear part and the front section are made in one piece.

5. The doctor blade as claimed in claim 3 wherein the doctor blade further comprises an intermediate piece which is joined between the rear part and the front section, with the intermediate piece being thicker than the front section and thinner than the rear part.

6. The doctor blade as claimed in claim 3 wherein the rear part comprises two or more parts lying on top of one another and connected to one another.

7. The doctor blade as claimed in claim 3 wherein the coating overlies at least one side of the front section and extends into a region which adjoins the front section.

8. The doctor blade as claimed in claim 3 wherein the coating is applied to overlie both sides of the front section of the blade.

9. A printing press which comprises a printing cylinder mounted for rotation about its axis, and a doctor blade for wiping excess ink off the surface of the rotating printing cylinder, said doctor blade being mounted immediately adjacent the printing cylinder so as to extend parallel to the axis of the printing cylinder and comprising a front section which interacts with the surface of the printing form, and which has a predetermined length, and a coating overlying at least one side of the front section of the blade, along at least substantially the entire length thereof, with said coating comprising a lubricant or a carrier material containing lubricant particles, and further comprising particles of a wear resistant material.

10. The printing press as claimed in claim 9 wherein the coating is applied to overlie only that side of the front section of the doctor blade which faces the direction of rotation of the printing cylinder.

11. The printing press as claimed in claim 9 wherein the front section of the doctor blade terminates in an inclined front contact zone which generally conforms to the surface of the printing cylinder.

* * * * *

UNITED STATES PATENT AND TRADEMARK OFFICE

CERTIFICATE OF CORRECTION

PATENT NO. : 6,305,282 B1
DATED : October 23, 2001
INVENTOR(S) : Dätwyler

It is certified that error appears in the above-identified patent and that said Letters Patent is hereby corrected as shown below:

Title page,
Item [56], References Cited, FOREIGN PATENT DOCUMENTS, line 3, "(WO)" should read -- (NL) --.

Signed and Sealed this

Second Day of April, 2002

*Attest:*

*Attesting Officer*

JAMES E. ROGAN
*Director of the United States Patent and Trademark Office*